US005434003A

United States Patent [19]

Medeiros et al.

[11] Patent Number: 5,434,003

[45] Date of Patent: Jul. 18, 1995

[54] ENTANGLED POLYAMIDE YARN

[75] Inventors: Robert W. Medeiros, Irmo; Lisa K. Owen, Columbia, both of S.C.; Thomas Y. Tam; Samir Z. Abdalla, both of Chesterfield, Va.

[73] Assignee: AlliedSignal Inc., Morris Township, Morris County, N.J.

[21] Appl. No.: 156,665

[22] Filed: Nov. 22, 1993

Related U.S. Application Data

[63] Continuation of Ser. No. 868,934, Apr. 16, 1992, abandoned.

[51] Int. Cl.[6] ..... D02G 3/00

[52] U.S. Cl. ..... 428/399; 428/369; 57/206; 57/209; 57/243

[58] Field of Search ..... 57/206, 209, 243; 428/369, 229, 357, 399

[56] References Cited

U.S. PATENT DOCUMENTS 2,985,995 11/1960 Bunting, Jr. et al. .
3,846,968 11/1974 Sheehan et al. .
4,118,921 10/1978 Adams et al. .
4,120,078 10/1978 Martin et al. .
4,237,187 12/1980 Raybon, Jr. et al. .
4,346,552 8/1982 Negishi et al. ..... 57/209
4,351,148 9/1982 Eschenbach ..... 57/209
4,430,780 2/1984 Sear et al. .
4,535,516 8/1985 Egbers et al. .
4,563,799 1/1986 Dammann .
4,729,151 3/1988 Runyon et al. .

FOREIGN PATENT DOCUMENTS 2113734A 12/1982 United Kingdom .

OTHER PUBLICATIONS

"An Insight into the Mingling Process" A. Demir and M. Acar, Textiles, Fashioning The Future, p. 169 (Textile Institute 1989).

*Primary Examiner*—N. Edwards
*Attorney, Agent, or Firm*—Melanie L. Brown; John E. Thomas; Roger H. Cass

[57] ABSTRACT

An entangled multifilament yarn, preferably an entangled multifilament polyamide yarn, and a knit fabric made from the same, wherein the yarn has an entanglement strength of at least about 4.5, an entanglement strength coefficient of variance of less than about 1.10, and an average entanglement length for each entanglement of at least about 11.0 mm. The yarn has a knitting performance of at least 4,000 racks/defect.

9 Claims, 3 Drawing Sheets

ENTANGLED POLYAMIDE YARN

This application is a continuation of application Ser. No. 07/868,934 filed Apr. 16, 1992, now abandoned.

BACKGROUND OF THE INVENTION

It is well known that yarn bundles of continuous fiber filaments lack cohesion between the individual filaments. During processing of the yarn bundles into textile products this lack of cohesiveness causes individual filaments to catch or snare on the processing equipment, thus leading to filament breakages and irregularities in the textiles. This problem is especially pervasive during knitting of the yarn bundles into a fabric. Non-cohesiveness of the yarn bundles also leads to excessive spreading of the filaments which increases the frictional contact between the processing equipment and the individual filaments resulting in abrasion and breakage.

One method for providing cohesion between the filaments is the use of what is known variously as entangling, mingling, commingling or interlacing. The term "entangling" will be used herein for convenience but the other equivalent terms could just as easily be substituted therefor.

Entangling is a process which forms a series of intermittent sections along the length of the yarn wherein the individual filaments are tightly entangled with each other. These entangled sections are known variously as entanglements, nips, nodes or knots and are separated from each other by lengths of filaments wherein the individual filaments are relatively parallel to each other. The entanglements act to prevent the individual filaments from spreading and splaying during processing of the yarn into a fabric, thereby maintaining a cohesive yarn bundle.

Conventional entangled yarn is formed by an apparatus referred to as an air jet. Numerous different air jet embodiments have been envisioned (see, e.g., U.S. Pat. No. 4,729,151 which includes an extensive discussion of the development of air jets). Indeed, there are many types of jets currently utilized such as closed jets, forwarding jets and slotted jets. All air jets, however, generally include a yarn chamber extending the length of the jet body which accomodates various yarn deniers and an air orifice which is used to direct an air flow into the yarn chamber to cause the entangling of the filaments. An air jet is presumed to form an entangled yarn as follows:

Within the air jet the loose bundle of continuous multifilament yarn is subjected to a turbulent gas stream contacting the yarn at right angles to its axis. The gas stream spreads open the filaments and, within the immediate vicinity of the spread open section, forms a plurality of vortexes which cause the filaments to become entangled. The alternating entanglement nodes and non-entangled sections are formed as the yarn travels through the chamber.

The prior art discloses entangled yarns which are produced at a high filament feed rate. For example, U.S. Pat. No. 4,535,516 discloses an air jet which is said to produce at high filament feed rates a multifilament yarn having at least 20 entanglements/meter. U.S. Pat. No. 4,237,187 discloses a process for producing an entangled multifilament polyamide yarn at windup speeds of from 3500 to 6000 meters/minute. Neither one of these patents, however, describe a yarn having sufficient entanglement strength.

Although attempts have been made to objectively characterize the relationships between the various parameters that effect entangling, the art of entangling remains highly unpredictable as noted, for example, by Demir and Acar in their "Insight Into the Mingling Process" paper presented at the Textile Institute World Conference, Oct. 1989, and published by the Textile Institute in *Textiles: Fashioning the Future.* One attempt to characterize a yarn in terms of the degree of entanglement is found in U.S. Pat. No. 4,118,921. This patent describes an entangled yarn having an entanglement pin count of 3 to 50 mm and the fibers having a number average fiber length of 18 to 60 cm with a distribution of fiber lengths such that at least 5 percent of the fibers are no longer than 12.7 cm, 50 to 93.5 percent are longer than 12.7 cm but no longer than 76 cm, and at least 1.5 percent are longer than 76 cm.

Prior efforts have been directed to the development of myriad air jets each serving a unique function in that they are designed to impart special limited characteristics to the entangled yarn. The emphasis has been placed upon achieving a certain distribution of entanglements, measured primarily in terms of entanglements per meter. There exists a need, however, for an entangled yarn with improved entanglement strength.

SUMMARY OF THE INVENTION

It is therefore an object of the present invention to provide an entangled yarn, and a textile product, preferably a fabric, made therefrom which is characterized by having a consistently high entanglement strength. A further object is to provide an entangled yarn which has enhanced knitting performance.

In accomplishing the foregoing objects there is provided according to the present invention a multifilament yarn, preferably a multifilament polyamide yarn, comprising a plurality of sections at which the individual filaments are entangled together to form entanglements, wherein the yarn has an entanglement strength of at least about 4.5, an entanglement strength coefficient of variance of less than about 1.10, and an average entanglement length for each entanglement of at least about 11.0 mm. The invention also includes a knit fabric made from the above-described entangled yarn.

Further objects, features and advantages of the present invention will become apparent from the detailed description of preferred embodiments that follows.

BRIEF DESCRIPTION OF THE DRAWING

The invention will be described in more detail below with reference to the drawing, wherein.

DETAILED DESCRIPTION OF THE INVENTION

Figure 1:
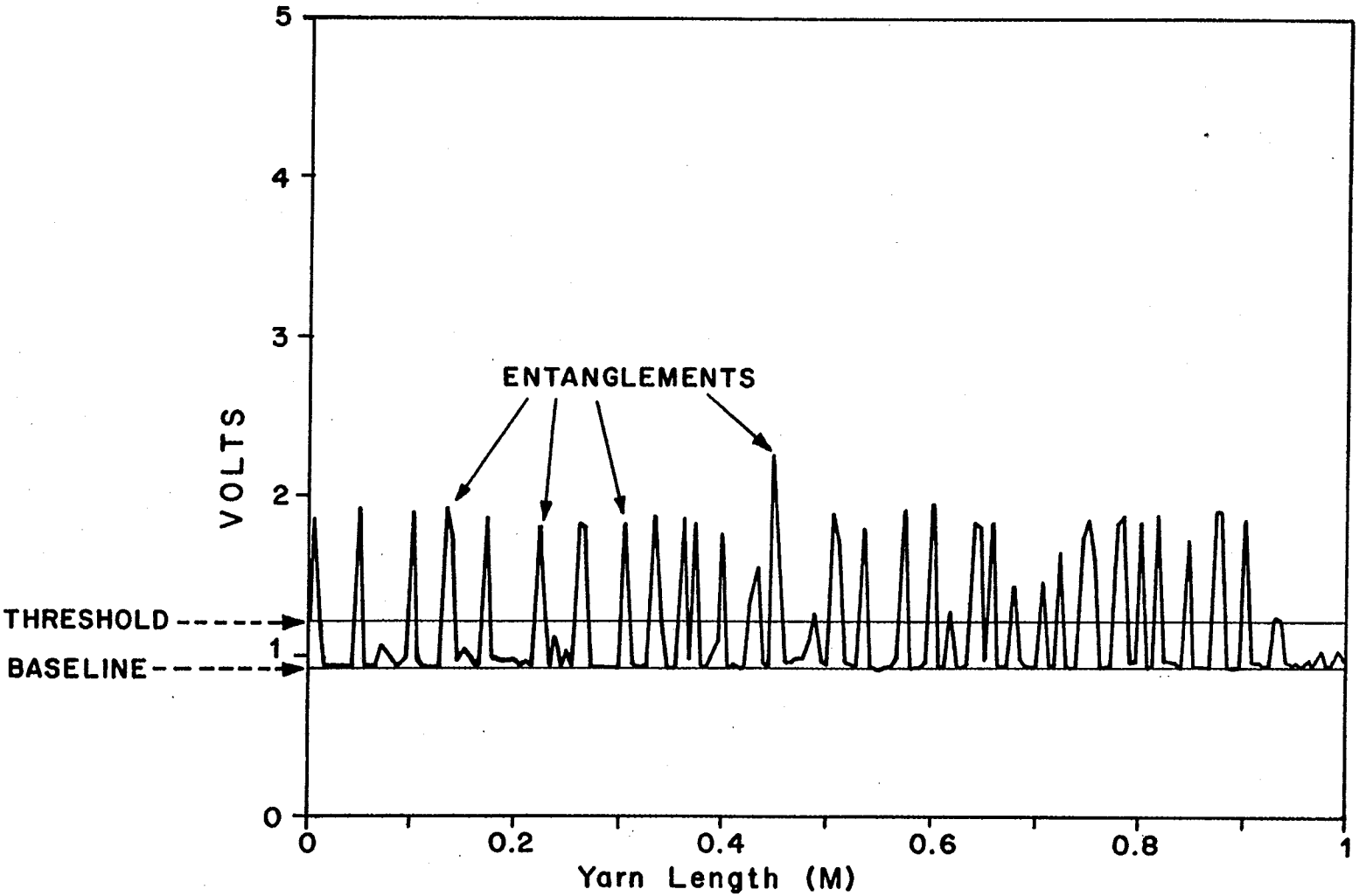
FIG. 1 is graphic computer representation of the entangling characteristics of an entangled yarn.

As used herein, "polyamide" denotes nylon 6, nylon 66, nylon 4, nylon 12 and other polymers containing the

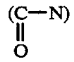

structure along with the $(CH_2)_x$ chain as described in Cook, J., *Handbook of Textile Fibres*, pp. 194–327 (Merrow Publishing Co. 1984).

"Continuous filament fiber" (also referred to herein as "filament") denotes a fiber-forming polymer which has been formed into an elongated shape which has a longitudinal length which is much greater than its cross-section. This is distinct from staple fiber which is continuous filament fiber that has been cut into short lengths so that it can be spun to produce spun yarn.

"Textile product" denotes a fibrous material such as apparel fabric which is comprised of continuous multifilament yarn.

"Continuous multifilament yarn" (also referred to herein as "yarn bundle") denotes an elongated profile which has a longitudinal length which is much greater than its cross-section and is comprised of a plurality or bundle of individual continuous filament fiber strands.

"Yarn package" denotes the continuous multifilament yarn after it has been subjected to air entangling but prior to being converted into beam yarn for the knitting process.

The continuous multifilament yarn of the present invention has a plurality of sections wherein the individual filaments are entangled together. These sections are referred to herein as "entanglements." The entanglements are separated by lengths of the yarn wherein the individual filaments are not entangled and are aligned substantially parallel.

All or only a portion of the individual filaments in each yarn bundle can be entangled together. In general, a section of the yarn wherein at least about 30% of the filaments are entangled is considered to constitute an entanglement for a fine denier yarn, i.e., a yarn having a total denier of 500 or below. Preferably, all or substantially all the filaments are entangled to provide greater entanglement strength. Variations in processing parameters such as yarn tension, air pressure and yarn speed, however, often make it difficult to achieve complete entanglement.

Due to the unique distribution, strength and size of the entanglements, the yarn of the present invention is able to achieve remarkable knitting performance. Prior to this invention, the art was unable to provide a yarn having dependable entanglement strength. As a result, when this yarn was knitted into a textile product the knitting apparatus had to be stopped frequently because the individual filament strands broke or splayed due to a loss of yarn cohesiveness.

An important characteristic of the yarn of the invention relates to the strength of the individual entanglements. As discussed previously, the entanglements serve to provide the yarn bundle with cohesiveness so that the downstream conversion of the yarn into a fabric will occur with a minimum of defects. In a typical process the yarn exiting the air jet undergoes a beaming process wherein the yarn package is converted into beam or warp yarn. During the beaming process tension is applied to the yarn which tends to cause the entanglements to pull out or became unraveled. Moreover, as the beam yarn is supplied from the beam to the knitting apparatus the yarn again is subjected to tension. It is critical, therefore, that the entanglements be provided with sufficient strength to withstand this tension applied to the yarn during processing.

To meet this strength requirement the yarn of the present invention has a surprisingly high entanglement strength of at least about 4.5, preferably about 5.0, and most preferably about 5.5. The entanglement strength is determined based on data generated from a commercially available entangling measuring instrument, namely a Reutlingen Interlace Counter Model RIC II.

The Rothschild pin drop method which is described, for example, in U.S. Pat. No. 3,566,683 is the conventional method for measuring the degree of entanglement. This method, however, only generates a number representing the number of entanglements per meter in the yarn. In order to provide a more detailed analysis of the entangled yarn characteristics, the Reutlingen Interlace Counter Model RIC II can be used.

When a yarn is conveyed through the Reutlingen unit it passes near a spring gauge. In general, a yarn is sent through the Reutlingen unit for 60 seconds at a rate of 10 meters/minute and a sampling rate of 30 readings/-second. When an entanglement contacts the spring gauge it pushes the spring down which produces a voltage output. This voltage output can be converted into a computer generated curve such as the one shown in FIG. 1. The peaks of the curve represent entangled sections and the valleys represent unentangled sections. A baseline and threshold level for the data represented on the computer readout then is calculated. The baseline is determined by sorting all the voltage values in ascending order and then averaging the lowest 30% of these values. The average number is the baseline. The threshold value depends on the denier of the yarn that is tested. For fine denier yarn, i.e., 500 denier or below, the threshold value is calculated by multiplying the baseline by a factor of 1.3. If a peak of the curve is below the threshold line, it is not considered to constitute an entanglement for measurement purposes. The entanglement strength is determined by integrally calculating the area between the curve peaks and the baseline, adding all these areas for a 1 meter yarn length and then dividing the total by the number of entanglements. The data represented by such a computer generated curve also can be utilized to determine other useful measurements of the entangled yarn, these measurements being described in more detail below.

One of these other measurements is the strength coefficient of variance (COV). The strength COV indicates the uniformity of the entanglement strength. That is to say, it represents the degree to which the entanglement strength of each entanglement varies. Determining a coefficient of variance for a given data set is a well known statistical analytical calculation. In this instance, the strength COV is the standard deviation of the average area between the computer generated curve peaks and the baseline divided by the average area between the computer generated curve peaks and the baseline, the data for the curve being obtained over a 1 meter yarn length.

The inventive yarn has a strength COV of less than about 1.10, preferably less than about 1.00, and more preferably less than about 0.90. If the strength COV is above these limits, the entanglement strength of the individual entanglements is insufficiently uniform. As a result, the weaker entanglements will pull out and lead to defects in the knitted fabric.

A third important measure of entanglement strength is the average of the entanglement lengths for each entanglement measured over a 10 meter yarn distance. The average entanglement length is primarily dependent on the speed of the yarn as it travels through the air jet. In general, it is expected that the average entanglement length would decrease as the speed of the yarn increases and vice versa.

The entangled section of the yarn may be only a short, sharp tie point, but preferably it is of a longer length. A longer entangled section results in higher entanglement strength and thus decreases the likelihood of the entanglement pulling out during processing. The yarn of the present invention has an average entanglement length of at least 11.0 mm, preferably 11.4 mm, and more preferably 11.8 mm.

Another characteristic of the yarn relates to the distribution of the entanglements. The distribution of the entanglements is also referred to in the art as the entanglement level. A common measure of this distribution is entanglements per meter (EPM), which measures the average number of entanglements per meter of yarn length. The yarn of the invention has an EPM of at least about 22, preferably about 24, more preferably about 27, prior to being subjected to tension. If the EPM is below this minimum level, there will be an insufficient number of entanglements to provide the entanglement strength necessary to achieve the improved knitting performance of the yarn. In general, there is no upper limit on the EPM, and the greater the EPM the greater the cohesiveness of the yarn.

EPM, however, does not measure the uniformity of the entanglement distribution. That is to say, EPM only provides the number of entanglements per meter without specifying how they are spaced within that meter. Accordingly, the uniformity of the entanglement distribution must be measured by other objective parameters such as the maximum skip length.

The maximum skip length is the maximum unentangled length of yarn over a 10 meter length. The longer the maximum skip length the more likely it is that the filaments will spread and cause a defect in the fabric. The yarn of the invention has a maximum skip length of less than about 125 mm, preferably less than 100 mm, and most preferably less than 80 mm, prior to being subjected to tension. There is not a maximum skip length which the yarn must be above and, in fact, it is desirable to achieve a low a maximum skip length as possible.

The fiber-forming polymer used for the yarn can be any polyamide. Preferred polyamides are nylon 6 and nylon 66, with nylon 6 being especially preferred.

The entangled yarn of the invention is obtained by adjusting the pressure of the air striking the yarn bundle, the tension of the yarn bundle as it passes through the air jet and the air jet dimensions depending upon the number of filaments in the yarn bundle, the desired denier of the entangled yarn and the desired level of entanglement strength for the entangled yarn. In each instance, the above-identified processing parameters are adjusted so that the air pressure is sufficient to separate the incoming yarn bundle and generate the vortex and resonance necessary to entangle the filaments.

The entangling of the yarn takes place in an air jet. The air jet used can have a conventional construction in that it includes a yarn chamber or bore through which the filaments pass and are subjected to a gaseous, preferably air, stream, at least one opening for the filaments to enter into the yarn chamber, at least one opening for the resulting entangled yarn to exit the yarn chamber, and at least one air orifice which directs the air or gas into the yarn chamber.

There is not a limit on the number of air orifices per yarn end in the air jet, but a single, double or triple orifice air jet is preferred. The air jets also can be arranged in tandem. That is, there can be more than one air jet for each yarn end. The air jet bore can be any shape such as oval, round, rectangular, half-rectangular, triangular or half-moon. The air stream can strike the filaments at any angle, but an approximate right angle is preferred.

When a half-moon, oval or round-shaped bore is used the orifice diameter/bore diameter ratio should be greater than 0.375, preferably at least about 0.400, more preferably at least about 0.475, and most preferably at least about 0.500. In the case of an oval-shaped bore, the bore diameter is measured at its widest distance.

The air or gas passing through the orifice and striking the filaments must be of sufficient pressure to achieve the degree of entanglement desired without causing any damage to the filaments, such as a rip or tear. The air pressure used to produce the yarn of the present invention should range from about 20 to about 150 psi, preferably from about 60 to about 120 psi. If the air pressure is below these ranges, the degree of entanglement and the entanglement strength will be below that required. If the air pressure is above these ranges, the filaments become damaged and/or the entanglements become non-uniform in strength. Moreover, the cost of supplying air or gas under pressure begins to rise dramatically as the pressure requirements are increased.

The air entangling takes place after the formation of the individual polyamide filaments and before the winding of the yarn into a beam yarn. The individual polyamide filaments can be formed by processes known in the art and can include any additives and/or finishes conventionally found with polyamide filaments. Typically, at the final stage of formation the filaments are extruded from a spinneret. The filaments can be transported through the air jet by any of the conventional methods for forming individual filaments into a yarn. Illustrative of these methods are draw twisting, draw winding, spin drawing and warp drawing. The preferred method for transporting the extruded filaments through the air jet, however, is via the direct draw entanglement method as described in U.S. Pat. No. 4,237,187, hereby incorporated by reference. The direct draw entanglement method is distinguished by the fact that drawing, entanglement and winding of the yarn onto a bobbin or spool all occur in a single continuous process. According to this process, the filaments extruded from the spinneret are aligned parallel to each other and transported around a first godet roll. The filaments can be quenched by conventional methods and passed through a meter finish guide prior to reaching the first godet roll. The filaments leave the first godet roll and pass through the air jet or jets for entanglement. The entangled yarn exits the air jet, is transported around a second godet roll, and then sent via a guide to a winder which wraps the yarn around a bobbin or spool to form the yarn package. The yarn package is then converted to beam yarn by conventional methods.

In this method the tension and speed of the yarn passing through the bore of the air jet is controlled by the rotating speeds of the first and second godet rolls. In general, one of the godet rolls rotates faster than the other godet roll, thereby applying tension to the yarn moving between them. In some circumstances, however, it may be desirable to control the yarn tension by means other than a set of godet rolls. For example, the yarn could be run through a series of rods set at different angles with respect to each other, a procedure commonly known as a shake-up ladder. Alternatively, a set of tension discs each having a different weight also could be used to control the yarn tension.

The preferred method for producing the yarn according to the invention is the direct draw entanglement with the two godet rolls. Preferably, the godet rolls rotate at about 3500 to about 5000 meters/minute, more preferably at about 3800 to about 4600 meters/minute, and most preferably at about 4500 to about 4550 meters/minute. The difference between the rotational speeds of the two godet rolls should be between about 5 to about 20 meters/min, with a difference of about 10 meters/minute being particularly preferred.

The number of individual filaments per entangled yarn bundle preferably ranges from about 12 to about 30. The total denier of the entangled yarn should be less than about 500. The preferred total denier of the yarn ranges from about 15 to about 45, with about 20 to about 40 being particularly preferred, and 40 being especially preferred. Also preferred are 200 and 400 total denier yarns. The amount of titanium dioxide incorporated into the polyamide filaments can be varied in a known manner to produce a bright, semi-dull or dull entangled yarn. Illustrative of preferred yarns are 20 denier/12 filaments (bright), 40 denier/12 filaments (dull, semi-dull, bright, and hydrophilic), 40 denier/20 filaments (bright), and 40 denier/30 filaments (bright).

The entangled yarn according to the invention is especially useful in apparel fabrics, particularly knit fabrics. The yarn can be made into a knit fabric via any conventional knitting process such as milanese, raschel, tricot, circular or flat knitting. The fabric can be a single knit or a double knit. The yarn also can be made into a woven fabric via any conventional weaving process.

It has been found unexpectedly that an entangled polyamide yarn having a node strength of at least about 4.5, a strength coefficient of less than about 1.10, and an average entanglement length of at least 11.0 dramatically improves the knitting performance over conventional entangled polyamide yarns. Only with a yarn having such a combination of improved entanglement strength characteristics is this superior knitting performance possible.

The knitting performance of a yarn on a knitter is evaluated primarily in terms of racks/defect of the top bar of the knitter. A rack is a standard measure for the length of a knit fabric. One rack is defined as consisting of 480 courses, a course being the row of loops or stitches running across a knit fabric.

Typical knitters used in the apparel industry have more than one bar through which the yarn from the beam is aligned into loops for subsequent intermeshing. Knitters having one top bar and one bottom bar are probably the most common. The entanglement strength of the yarn supplied to the top bar is the most critical since a longer length of yarn from the beam is required per rack for the top bar than for the bottom bar. For example, with a 32 gauge top bar (gauge is the number of needles per inch) and a 32 gauge bottom bar, for each rack of fabric about 60 inches of yarn is necessary for feeding into the top bar compared to the approximately 45 inches necessary for feeding into the bottom bar. Due to the extra length of yarn feeding into the top bar, this yarn is more slack and thus entanglement strength is more important to maintain cohesion between the filaments.

Conventional polyamide entangled yarns provide a knitting performance of at most 2,500 racks/defect for the top bar yarn. In other words, on average, conventional polyamide entangled yarns can at most provide 2,500 racks of knit fabric from the top bar before a defect in the fabric occurs. This defect typically causes the knitting machine to stop eventually. With the yarn of the invention, on the other hand, a greatly improved knitting performance of at least about 4,000 racks/defect for the top bar yarn can be achieved.

The primary reason behind the superior knitting performance of the yarn is the greater strength of the yarn's entanglements. For comparative purposes, the entanglement strengths of a control yarn, 4 yarns according to the invention (Examples A–D) and 1 commercially available yarn were measured. All the measurements were taken without subjecting any of the yarns to tension.

The control yarn is a 40 denier yarn consisting of 12 nylon 6 filaments. The filaments were subjected to air entangling in a single orifice air jet with a half-moon-shaped bore and a 0.375 orifice diameter/bore diameter ratio. The air pressure was 120 psi and the lower godet roll speed was 4200 meters/minute. The inventive yarn examples are 40 denier/12 filaments nylon 6. Example A was produced with a double orifice air jet having an orifice diameter/bore diameter ratio of 0.500 and at a godet roll speed of 4500 to 4540 meters/minute and an air pressure of 100 to 120 psi. Example B was produced with a triple orifice air jet having an orifice diameter/bore diameter ratio of 0.474 and at a godet roll speed of 4500 to 4540 meters/minute and an air pressure of 80 to 120 psi. Example C was produced with tandem single orifice air jets having an orifice diameter/bore diameter ratio of 0.376 and at a godet roll speed of 4500 to 4540 meters/minute and an air pressure of 80 to 120 psi. Example D was produced with tandem triple orifice air jets having an orifice diameter/bore diameter ratio of 0.474 and at a godet roll speed of 4500 to 4540 meters/minute. Commercial yarn A is a 40 denier/13 filaments entangled polyamide yarn available from E.I. dupont de Nemours & Co. under the product name ABKA #683.

The results of the comparative strength measurements are shown in Table 1. It is apparent that the inventive yarns (Examples A–D) have superior entanglement strength, uniformity of entanglement strength and average entanglement length.

TABLE 1

| YARN | EPM | Max. Skip (MM) | Entanglement Strength | Strength COV | Average Entangle. Length (MM) |
|---|---|---|---|---|---|
| Control | 16.0–20.0 | 244–283 | 1.8–3.2 | 1.3 | N.A. |
| Example A | 26.0 | 75.0 | 6.3 | 1.03 | N.A. |
| Example B | 22.8 | 96.6 | 5.4 | 0.99 | N.A. |
| Example C | 24.7 | 124.5 | 4.7 | N.A. | N.A. |
| Example D | 27.5 | 71.0 | 6.3 | 0.88 | 11.8 |
| Commercial A | 30.0 | 72–127 | 2.0 | 1.1 | 8.36 |

Figure 2:
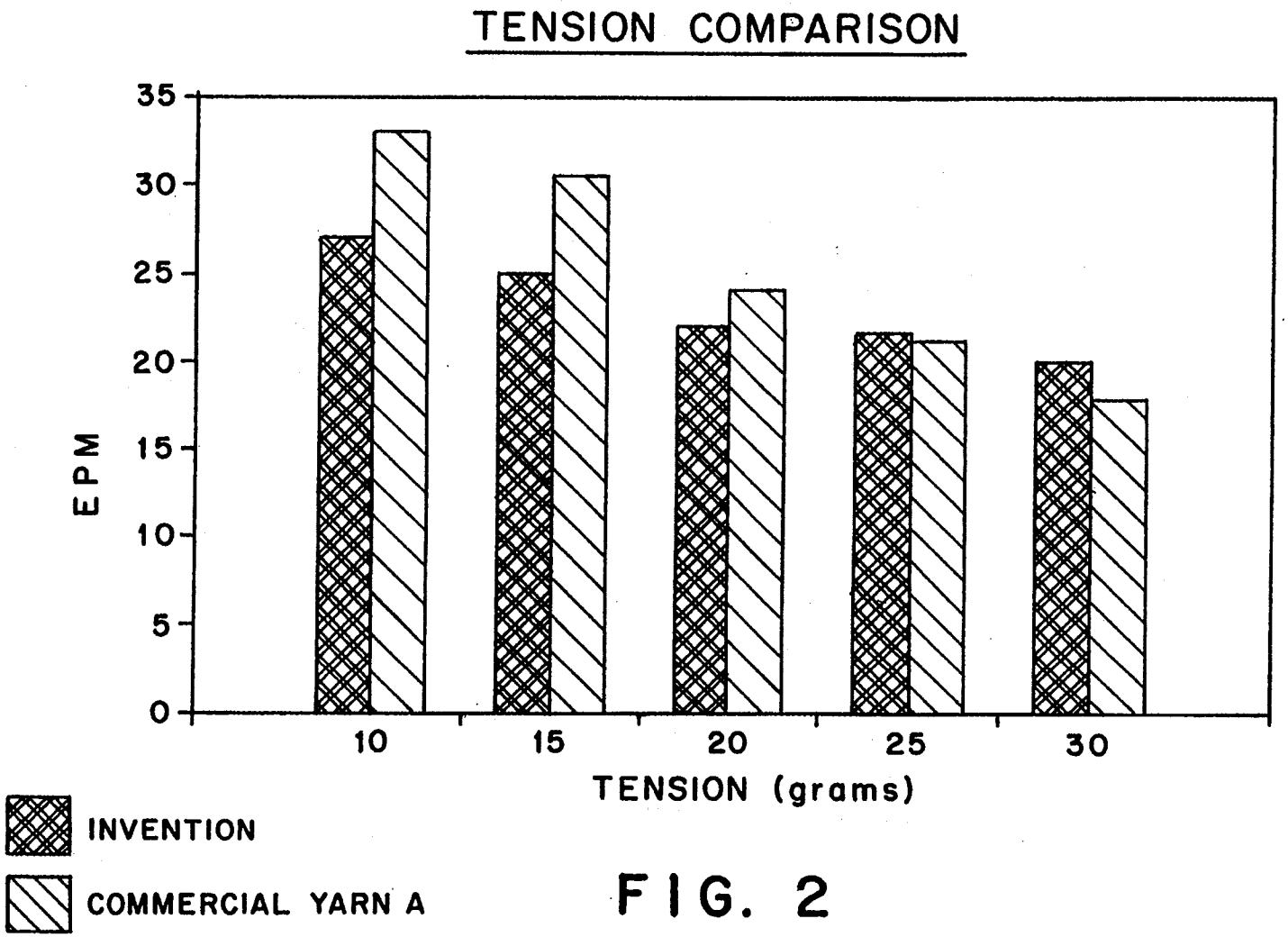
FIG. 2 is a graphic representation of the comparative entanglements per meter of a yarn according to the invention and a commercially available yarn.
Figure 3:
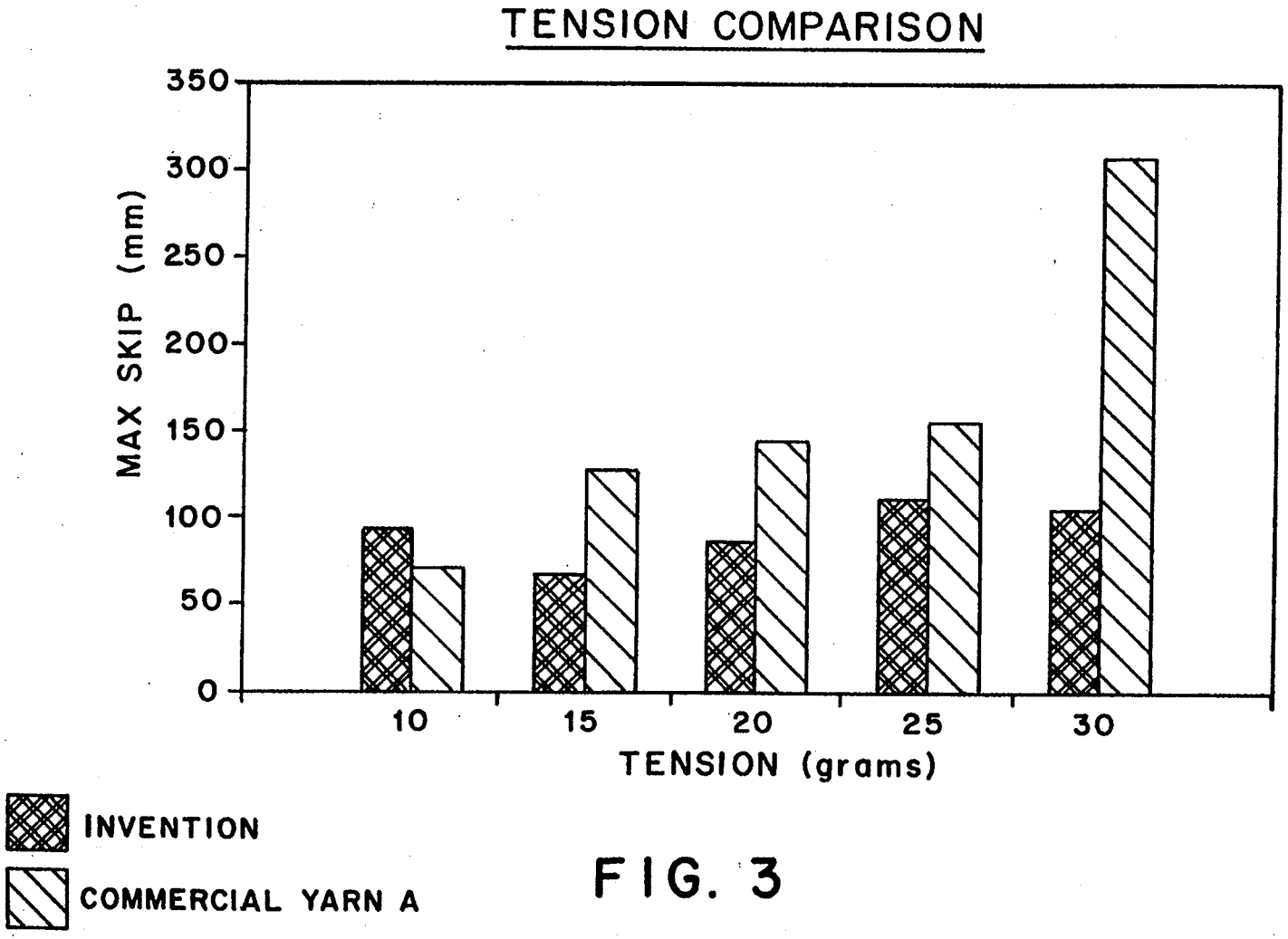
FIG. 3 is a graphic representation of the comparative maximum skip length of a yarn according to the invention and a commercially available yarn.

Both the inventive yarn and commercial yarn A were subjected to tension to test further their relative entanglement strengths. The inventive yarn used in the tension test was 40 denier/12 filaments nylon 6 that had been entangled by tandem three orifice air jets having an orifice diameter/bore diameter of 0.500 at an air pressure of 120 psi and a godet roll speed of 4500 to 4550 meters/minute. This tension test simulates the amount of tension which the yarns typically undergo during conversion of the yarn package into a knitted fabric. The results are shown in FIGS. 2 and 3.

Even though the commercial yarn initially has a higher EPM and lower maximum skip length than the inventive yarn, FIGS. 2 and 3 demonstrate that as greater tension is applied to the yarns the EPM of the commercial yarn drops below that of the inventive yarn and the maximum skip length increases over that of the inventive yarn. Clearly, the entanglements of the commercial yarn are pulled out to a much greater extent than the entanglements of the inventive yarn due to the weaker entanglement strength of the commercial yarn.

Table 2 compares the knitting performance of the control yarn and the yarns of Examples B–D. The control yarn and the yarns of Examples B–D were knit into a fabric on a two bar knitter having 32 gauge top and bottom bars. These results show that the inventive yarn achieves a greatly superior knitting performance than a yarn, such as the control yarn, having entanglement strength characteristics below that of the inventive yarn.

TABLE 2

| YARN | RACKS/DEFECT (TOP BAR - 32 GAUGE) |
|---|---|
| Control | 2,000 |
| Example B | 5,000 |
| Example C | 13,440 |
| Example D | 33,228 |

From the foregoing description, one skilled in the art can easily ascertain the essential characteristics of this invention, and without departing from the spirit and scope thereof, can make various changes and modifications of the invention to adapt it to various usages and conditions.

We claim:

1. A multifilament polyamide yarn comprising a plurality of sections at which the individual filaments of the multifilament polyamide yarn are entangled together to form entanglements, wherein the multifilament polyamide yarn has a total denier of 500 or less, an entanglement strength of at least 4.5, an entanglement strength coefficient of variance of less than 1.10 over a one meter length of the multifilament polyamide yarn, an average entanglement length for each entanglement of at least 11.0 mm, an entanglement per meter of at least 22 and a maximum skip length of less than 125 mm.

2. A multifilament yarn according to claim 1, wherein the multifilament yarn has an entanglement strength of at least 5.0, an entanglement strength coefficient of variance over a one meter length of the multifilament yarn of less than 1.00, and an average entanglement length for each entanglement of at least 11.4 mm.

3. A multifilament yarn according to claim 2, wherein the multifilament yarn has an entanglement strength of at least 5.5, an entanglement strength coefficient of variance over a one meter length of the multifilament yarn of less than 0.90, and an average entanglement length for each entanglement of at least 11.8 mm.

4. A multifilament yarn according to claim 2, wherein the multifilament yarn includes 12 to 30 filaments.

5. A fabric produced from a plurality of multifilament polyamide yarns wherein each multifilament polyamide yarn has a total denier of 500 or less and comprises a plurality of sections at which the individual filaments of the multifilament polyamide yarn are entangled together to form entanglements, wherein the multifilament polyamide yarn has an entanglement strength of at least 4.5, an entanglement strength coefficient of variance of less than 1.10 over a one meter length of the multifilament polyamide yarn, an average entanglement length for each entanglement of at least 11.0 mm, an average entanglement per meter of at least 22 and an average maximum skip length of less than 125 mm.

6. A fabric according to claim 5, wherein the multifilament yarn has an entanglement strength of at least 5.0, an entanglement strength coefficient of variance over a one meter length of the multifilament yarn of less than 1.00, and an average entanglement length for each entanglement of at least about 11.4 mm.

7. A fabric according to claim 6, wherein the multifilament yarn has an entanglement strength of at least 5.5, an entanglement strength coefficient of variance over a one meter length of the multifilament yarn of less than 0.90, and an average entanglement length for each entanglement of at least 11.8 mm.

8. A fabric according to claim 1, wherein the multifilament yarn includes 12 to 30 filaments.

9. A fabric according to claim 5, wherein the fabric is a knit fabric.

* * * * *